United States Patent [19]

Dixon

[11] 4,103,463

[45] Aug. 1, 1978

[54] PORTABLE WALL SYSTEM

[75] Inventor: Guy E. Dixon, Maimi, Fla.

[73] Assignee: Panelfold Doors, Inc., Miami, Fla.

[21] Appl. No.: 727,605

[22] Filed: Sep. 28, 1976

[51] Int. Cl.[2] ..... E04B 2/74; E04H 3/02

[52] U.S. Cl. ..... 52/122; 52/127; 52/143; 52/241

[58] Field of Search ..... 52/122, 127, 238, 241, 52/242, 143

[56] References Cited

U.S. PATENT DOCUMENTS

| | | | |
|---|---|---|---|
| 1,716,625 | 6/1929 | Dawson | 52/122 |
| 2,443,548 | 6/1948 | Wilson | 52/122 |
| 2,945,568 | 7/1960 | Chasteney | 52/143 |
| 3,386,216 | 6/1968 | Zwickert | 52/242 |
| 3,453,790 | 7/1969 | Harris | 52/122 |
| 3,566,559 | 2/1971 | Dickson | 52/122 |

FOREIGN PATENT DOCUMENTS

| | | | |
|---|---|---|---|
| 384,824 | 2/1965 | Switzerland | 52/127 |

*Primary Examiner*—John E. Murtagh

*Attorney, Agent, or Firm*—Clarence A. O'Brien; Harvey B. Jacobson

[57] ABSTRACT

A portable wall system utilizing portable wall panels defining a wall or partition extending between a floor surface or other lower surface and a ceiling surface or other overhead surface. The portable wall panels each include lower support means for movably supporting the panels on a floor surface to facilitate movement of the panels to a desired location. The upper edge of each panel is provided with a spring biased ceiling or overhead surface engaging member and the lower edge of each panel includes a vertically extendible and retractable floor surface engaging member so that the wall panels will form a complete partition between the floor surface and ceiling surface and be easily installed, removed or released and relocated. The side edges of the wall panels are constructed for inter-engagement with similar panel modules or wall mounted receptors.

10 Claims, 8 Drawing Figures

PORTABLE WALL SYSTEM

BACKGROUND OF THE INVENTION

1. Field of the invention

This invention relates to an improved portable wall system incorporating one or more portable panels having support means along the bottom edge for movable supporting engagement with a floor surface to facilitate movement of the panel and extendible and retractable floor surface engaging means at the lower edge of the panel and spring biased extendible and retractable ceiling surface engaging means at the upper edge thereof to provide for easy installation of the panels in a desired location and to facilitate movement of the panels along a floor surface.

2. Description of the Prior Art

Movable partitions, panels, room dividers and the like for dividing an enclosed space into smaller spaces or enclosing a space or otherwise providing a partition are generally well known and usually include a panel having requisite physical characteristics required by the particular installation and structures for releasably securing the panels between a floor surface and a ceiling. Such panels are frequently constructed of standard size modules which are relatively heavy and awkward to handle. Also, in some instances, the vertical height of the panels is increased or decreased to secure them in position with the increase in vertical height sometimes resulting in damage to or displacement of the ceiling surface, particularly if the ceiling surface is formed by acoustical tile or the like or if the ceiling surface is in the form of a drop ceiling. Prior U.S. patents illustrative of the development in this field of endeavor are as follows:

U.S. Pat. Nos. 2,742,675 filed on 4/24/56; 2,886,147 filed on 5/12/59; 2,945,568 filed on 7/19/60; 2,962,132 filed on 11/29/60; 3,174,593 filed on 3/23/65; 3,335,532 filed on 8/15/67; 3,400,504 filed on 9/10/68; 3,453,790 filed on 7/8/69; 3,753,328 filed on 8/21/73; 3,967,420 filed on 7/6/76.

SUMMARY OF THE INVENTION

An object of the present invention is to provide a portable wall system in the form of a plurality of portable wall panels with each panel including supporting means along the lower edge thereof to enable moving supporting engagement with a floor surface and a structure to increase or decrease the effective vertical height of the panel to facilitate installation of the panels between a floor and a ceiling and removal of the panel from a position between a ceiling and floor as well as movement of the panel along a supporting surface to a desired location.

Another object of the invention is to provide a wall panel in accordance with the preceding object in which the lower edge of the wall panel is provided with a vertically extending and retracting seal member of generally channel shaped configuration telescoped in relation to the lower edge of the panel with mechanical devices inter-connecting the lower edge of the panel and the channel shaped member for extending and retracting the channel shaped member in relation to the lower edge of the panel for changing the effective vertical heighth of the panel.

Still another object of the invention is to provide a wall panel in accordance with the preceding objects in which the upper edge of the panel is provided with a spring biased ceiling engaging member generally of U-shaped configuration telescopic in relation to the upper edge of the panel and spring biased in relation thereto with the spring bias being a relatively small force so that the force exerted on the ceiling will not damage the ceiling surface or displace ceiling components retained in position by gravity or the like.

Yet another object of the invention is to provide wall panels in accordance with the preceding objects in which the structure supporting the lower edge of the panel for movement along a floor surface is in the form of a rotatable ball member, caster wheel, caster device or fixed axis wheel arrangements.

Still another important feature of the invention is to provide a portable wall system including wall panels in which the side edges of the panels and the walls of an enclosure or the like are provided with inter-engaging means for retaining the panels in alignment with each other with each of the panels including a peripheral seal for providing isolation of one surface of the panel from the other and thus preventing transfer of heat, light and sound from one side of the panel or portable wall to the other.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
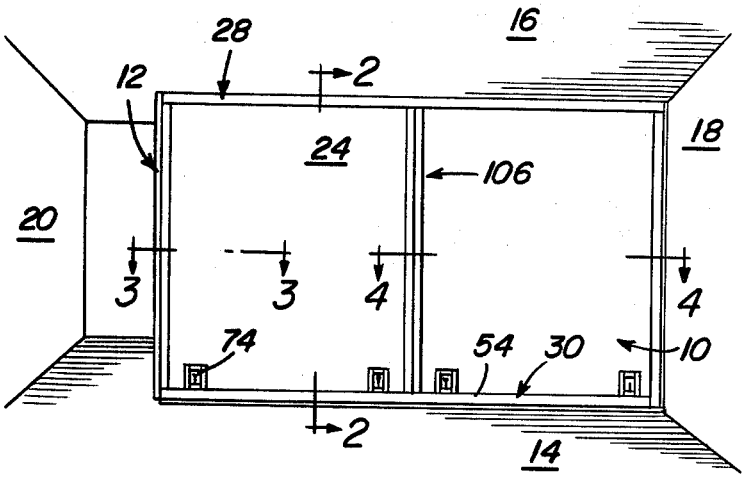
FIG. 1 is a schematic illustration of the portable wall system of the present invention installed in an enclosed space.

Referring now specifically to the drawings, the portable wall system of the present invention is generally designated by the numeral 10 and includes a plurality of wall panels 12 arranged in vertical orientation and horizontal alignment to form a partition, room divider or portable wall between a floor surface 14 and a ceiling surface 16 with the portable panels 12 extending between vertical side walls 18 and 20 of an enclosed space or the like. The wall panels 12 may be constructed of any desired standard size modules and may be constructed of various sizes to be installed in spaces having different heighth dimensions or width characteristics.

Each wall panel 12 includes a pair of planar panel members 22 and 24 disposed in spaced parallel relation to each other and secured to a peripheral frame 26. The panel members 22 and 24 may be constructed of wood, plastic, metal or any other material used in constructing walls and provided with any external ornamentation or appearance characteristics as desired. For example, various types of wallboards, laminated panels, flake board or the like may be used for this purpose with insulating material therebetween if desired with the overall thickness of the panel 12 being varied as desired so that the physical characteristics of the panels 12 will be compatible with the enclosed space in which the panels are used and be capable of being moved to a desired location and handled by individuals. The peripheral frame 26 is of channel shaped configuration with the bight portion thereof disposed inwardly and the two legs extending to a point adjacent the periphery of the panel members 22 and 24 and being secured thereto in any suitable manner with the peripheral frame 26 being preferably in the form of extruded channel shaped members with the channel shaped frames 26 in the vertical edges of the panels having their webs disposed generally flush with the periphery of the panel members 22 and 24. The specific construction of the panel members and the specific construction of the frame supporting these panel members may be varied and in and of itself does not constitute an essential element of the present invention.

The upper edge of the panel 12 is provided with a spring biased, inverted channel shaped seal assembly generally designated by numeral 28 for engaging the ceiling surface 16. The lower edge of the panel 12 is provided with a similar type of channel shaped seal assembly 30 which is vertically extendible and retractable for sealing engagement with the floor surface 14. Also, the lower edge of the panel 12 is provided with a plurality of supporting assemblies generally designated by numeral 32 for movable supporting engagement with the floor surface 14. The channel shaped floor engaging seal assembly 30 is vertically extended and retracted by an elevating and lowering mechanism generally designated by numeral 34.

The floor engaging supporting assembly includes a balltype caster 36 journalled in a housing 38 fixedly supported on a bracket 40 by a nut and bolt assembly 42. The bracket 40 is fixedly secured to the channel shaped peripheral frame 26 by suitable screw threaded fasteners 44 or the like. A plurality of the ball caster type supporting assemblies are provided on each panel with each panel including at least two of the ball casters 36 for rolling contact with the floor surface 14 to facilitate movement of the panels 12 along the floor surface 14 to enable an individual to roll the panel 12 to a desired location when the panel has a vertical heighth less than the distance between the floor and ceiling.

Figure 2:
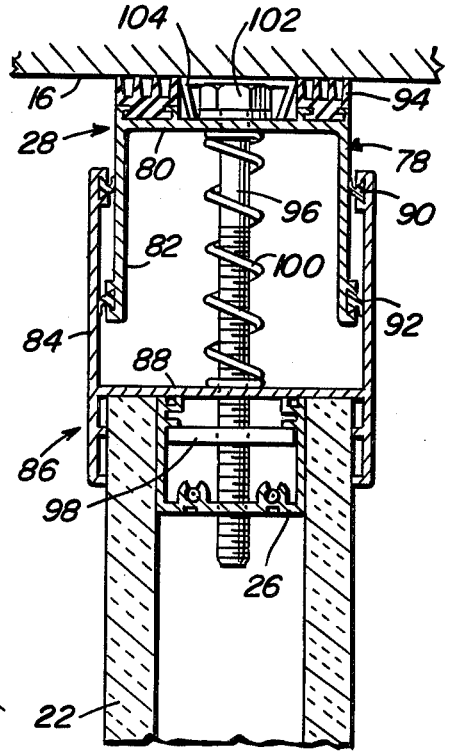
FIG. 2 is a vertical sectional view, on an enlarged scale, taken substantially upon a plane passing along section line 2—2 of FIG. 1 illustrating the structural details of a portable wall panel employed in the wall system.
Figure 7:
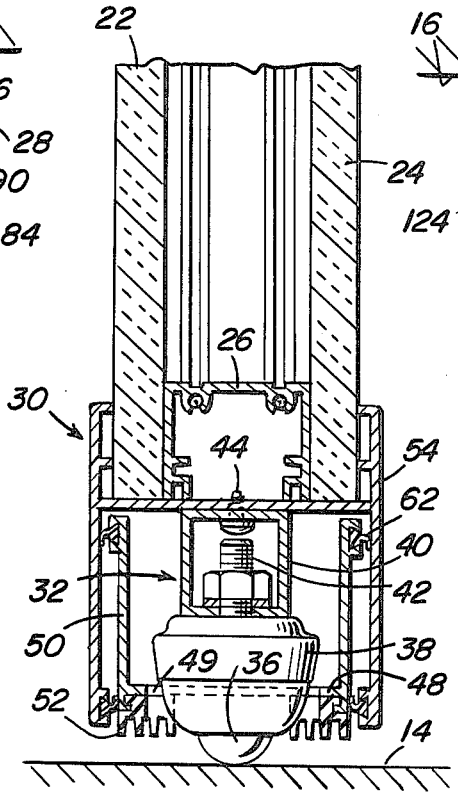
FIG. 7 is a vertical sectional view taken substantially upon a plane passing along section line 7—7 of FIG. 6 illustrating further structural details of the ball caster support and the associated channel shaped member having seals along the bottom edge thereof.

The floor engaging seal assembly 30 includes a channel shaped member 46 having a bight portion 48 paralleling the floor surface 14 and a pair of parallel legs 50 extending upwardly toward the panel members 22 and 24 as illustrated in FIGS. 2 and 7. The lower surface of the bight portion 48 is provided with a pair of depending sealing members 52 in the form of a multiple blade sweeping or gripping member constructed of vinyl, rubber or the like for engagement with the floor surface 14 at a plurality of parallel lines of engagement. The legs 50 of the U-shaped member 46 are telescoped between a pair of depending strips 54 which form the outer components of an H-shaped member 56 having the web portion 58 thereof extending across the bottom edges of the panel members 22 and 24 and the peripheral frame 26 as illustrated FIGS. 2 and 7. The bottom inner edge of each strip 54 is provided with a vinyl seal 60 and the upper outer surface of each leg 50 is provided with a similar seal 62 thus forming a continuous seal between the panel 12 and the floor surface 14 when the sealing strips 52 are in engagement with the floor 14.

Figure 6:
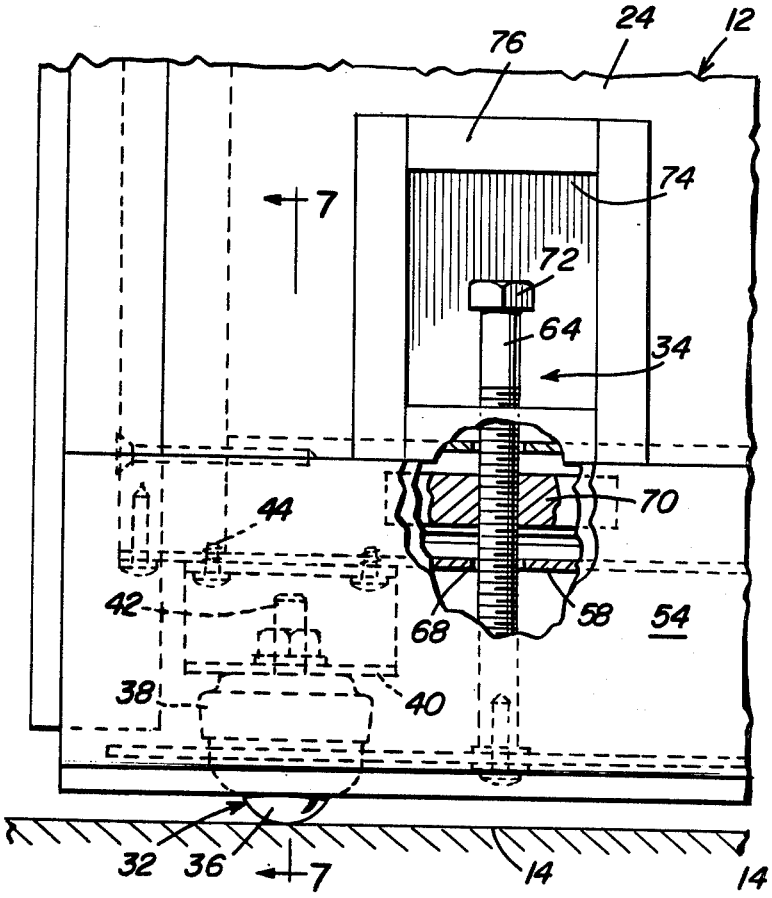
FIG. 6 is an enlarged front elevational view, with portions broken away, of the lower corner portion of a wall panel.
Figure 6:
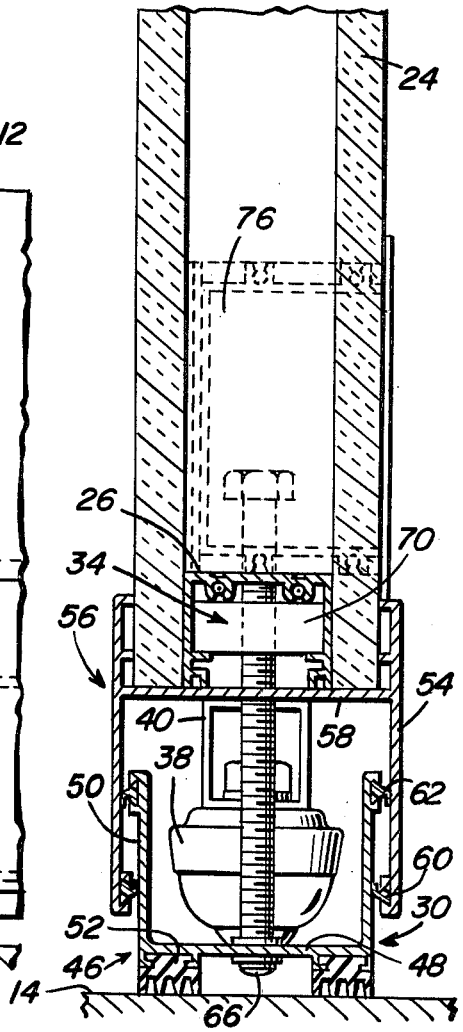

The elevating and lowering mechanism 34 includes an elongated threaded bolt 64 having its lower end swivelly connected to the bight portion 48 of the U-shaped member 46 as indicated by reference numeral 66. The swivel connection may be of any suitable detachable type of connection which rotatably connects the bolt 64 to the bight portion 48 of the U-shaped member 46. The bolt 64 extends up through an aperture 68 in the web 58 and the bolt 64 is threaded through a thread block 70 fixedly secured in the peripheral frame 26 as illustrated in FIGS. 2 and 6. The upper end of the bolt 64 is provided with a polygonal head 72 disposed in a recess 74 formed in the panel 12 in which the recess is defined by a box-like housing 76 extending inwardly from the outer surface of the panel member 24 so that the recess 74 is open to the exterior surface of the panel member 24 thereby providing access to the head 72 of the bolt 64 so that the bolt 64 can be rotated by a suitable powered wrench, manual ratchet wrench or the like. Thus, by rotating the bolt 64, the U-shaped member 46 may be elevated and lowered. When the U-shaped member 46 is lowered, as illustrated in FIG. 2, the bight portion 48 and the seals 52 thereon are positioned below the ball caster 36 and the ball caster 36 is elevated out of contact with the floor surface 14. When the U-shaped member 46 is elevated, as illustrated in FIGS. 6 and 7, the aperture 49 in bight portion 48 enables the bight portion 48 and the sealing strips 52 to be elevated above the lower periphery of the ball caster 36 so that the panel 12 then will be rollingly supported on the floor surface. As illustrated, two of the elevating and lowering mechanisms 34 are provided and they are positioned adjacent the supporting assemblies 32 as illustrated in FIG. 6.

The ceiling engaging seal assembly 28 includes an inverted U-shaped member 78 having a bight portion 80 and a pair of parallel depending legs 82. The legs 82 are telescopically received between two parallel strips 84 forming a portion of an H-shaped member 86 having a web 88 extending transversely of the upper edges of the panel members 22 and 24. The upper inner surfaces of these strips 84 have a sealing strip 90 thereon and the lower outer surfaces of the legs 82 have a sealing strip 92 thereon. The bight portion 80 is provided with sealing strips 94 of the type having multiple sealing edges for engaging the ceiling surface 16 thereby providing a continuous seal for the upper end of the panel 12. A threaded bolt 96 extends down through the bight portion 80 and threads through a thread block 98 secured in the peripheral frame 26. A coil spring 100 encircles the bolt 96 and has its lower end engaged with the web 88 and its upper end engaged with the bight portion 80 of the U-shaped member 78 thus spring biasing the U-shaped member 78 upwardly. The coil spring 100 has widely spaced convolutions and is capable of exerting average diameter of pores was 95 Å and the total free volume of pores amounted to 80%.

EXAMPLE 4

The gel prepared according to Example 3 was heated, after processing in amyl acetate and washing with ethanol and distilled water, in an autoclave for 8 hours to 220° C with the amount of water corresponding to twice its loose volume. After this processing, the gel was stirred into diluted hydrochloric acid (5 times diluted 36% HCl, analytical grade) and left in the solution for 2 hours at the temperature 80° C. It was then washed with water and dried at 450° C for 6 hr. The obtained material was heated in distilled water to boiling. The latter cycle was repeated three times.

The final product consisted of perfectly spherical particles of silicagel of size 30 - 60 μm (80%) suitable for chromatography both in water and organic solvents. The gel separated according to mol. weight in THF in the range $5\times10^3 - 5\times10^5$. Dextran fractions were separated in water on this gel in the range $1\times10^4 - 1\times10^6$. For toluene in THF (1 ml/min), separation efficiency of 5300 TP/m was found in a column of 90 cm length and 0.8 cm diameter. The fraction 30 - 60 μm was used for packing of this column. For n-propanol in water, 3500 TP/m was found under the same conditions. Mercury porosimetry showed a very narrow distribution of pore sizes in the gel ($\bar{r}$ = 250 Å). The total free volume of pores amounted to 80%.

EXAMPLE 5

Silicagel was treated in the same way as in Example 4, only the temperature in autoclave was 250° C.

The final product consisted of perfectly spherical particles (80% between 30 and 60 μm) of silicagel with a narrow distribution of size, which were suitable for chromatography both in aqueous and organic media. The separation power according to molecular weights was $1\times10^4 - 1\times10^6$ units of mol. weight for polystyrene in THF. A distinct separation by molecular weight was observed even with the highest fraction used, which had the average molecular weight $2\times10^6$. For the column packed with a gel of particle size 30 - 100 μm (column length 90 cm, diameter 0.8 cm), there was found 3800 TP/m for toluene as the testing substance in THF. The same column gave 3300 TP/m for n-propanol in water (1 ml/min). A very narrow distribution of pore sizes with the average radius 330 Å was found by mercury porosimetry. The total volume of pores in the gel was 75%.

EXAMPLE 6

Commercial water glass (cf. Example 1, 255 ml) was mixed with 630 ml of distilled water and cooled to the temperature 0° C. Into this solution, there were added 90 ml of glacial acetic acid (analytical grade) and 37.5 g KCl dissolved in 105 ml of distilled water (35° C). The solution was filtered by suction and dispersed in a mixture of 200 ml of tetrachloromethane and 600 ml of cyclohexane. The organic phase contained 2.7 g of octadecylamine previously dissolved. The mixture was intensively stirred (1500 r.p.m.) in a round-bottomed flask for 20 minutes at 50° C. The obtained hydrogel was further processed in the same way as in Example 3.

The final product consisted of perfectly spherical particles of silicagel of the size 3 - 30 μm (80% of particles). They were used, after fractionation according to size, for packing of microcolumns for high-speed liquid chromatography. The column packed with the fraction of particle size around 20 μm (column length 30 cm, $r$ = 2 mm) exhibited 32,000 TP/m for toluene in heptane (flow rate 0.2 ml/min).

We claim:

1. A method of preparing perfectly spherical particles of silicagel with controlled particle size and with controlled pore dimensions comprising the following steps:

A. preparation of a hydrogel by:
   (1) acidifying a solution of an alkali metal silicate by an organic acid miscible with water;
   (2) emulsifying said solution in a combination of organic liquids which is selected from the group consisting of chloroform-hexane, tetrachloromethane-hexane, tetrachloromethane-cyclohexane, and tetrachloromethane-petroleum fraction; said fraction having a distillation range of 60° - 80° C. in the presence of octadecylamine;
   (3) agitating the emulsion until a silica hydrogel is formed;

B. preliminary hardening of said hydrogel by heating above 100° C. a suspension of the hydrogel in a liquid boiling above 100° C., said liquid being selected from the group consisting of amyl acetate, dibutyl sebacate, glycol, glycerol, and phosphoric acid;

C. hydrothermal processing of the hardened hydrogel by heating same with water in an autoclave at 150° C. to 300° C. at a pressure corresponding to the vapor pressure of water at the temperature used; and D. final hardening of the gel by:
   (1) heating of the gel at 300° - 900° C.;
   (2) boiling the gel in water; and
   (3) repeating steps D(1) and (2) three times.

2. The method of claim 1 wherein an organic acid selected from the group consisting of acetic acid and formic acid is used in acidification step A(2).

* * * * *

UNITED STATES PATENT OFFICE

CERTIFICATE OF CORRECTION

Patent No. 4,103,463 Dated August 1, 1978

Inventor(s) Guy E. Dixon

It is certified that error appears in the above-identified patent and that said Letters Patent are hereby corrected as shown below:

Columns 5, 6, 7 and 8 should be canceled and columns 5, 6, 7 and 8 as shown on the attached sheets substituted therefor, but will apply to the patent grant only.

Signed and Sealed this

*Eighth* Day of *May 1979*

[SEAL]

*Attest:*

RUTH C. MASON
*Attesting Officer*

Figure 5:
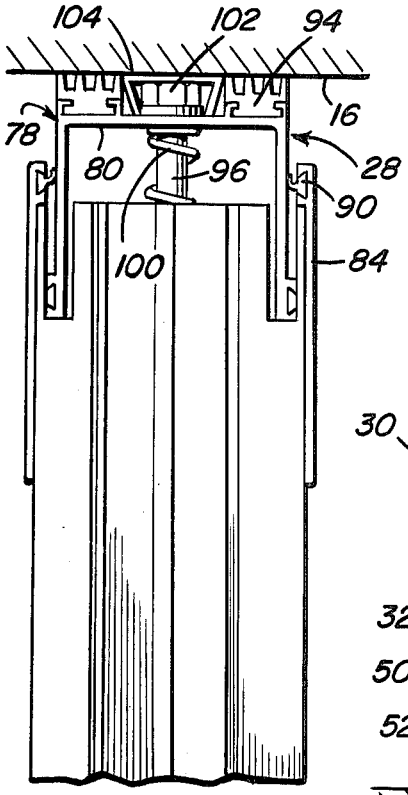
FIG. 5 is an enlarged end elevational view of the upper edge portion of one of the wall panels.

DONALD W. BANNER
*Commissioner of Patents and Trademarks* only a relatively small force against the U-shaped member 78 which is sufficient to retain the channel shaped member and the seals thereon against the ceiling but not sufficient to damage the ceiling. The upper end of the bolt 96 is provided with a polygonal head 102 which enables adjustment of the threaded bolt 96 through the thread block 98 which is capable of floating vertically in the peripheral frame 26 so that the bolt 96 and the U-shaped member 78 will move downwardly in unison when upward pressure is exerted thereon by lowering of the lower seal assembly 30. Since the spring 100 will provide a "light touch" of the seal strips 94 with the ceiling surface 16, downwardly opening U-shaped clips, tracks or guides 104 are secured to the ceiling 16 in the location where the wall 10 is to be installed with the downwardly opening channels 104 receiving the polygonal head 102 of the bolts 96 as illustrated in FIGS. 2 and 5 so that the wall 10 does not rely upon the vertical elongation of the panels 12 jamming the upper and lower edges against the ceiling and floor respectively which could damage the ceiling structure when the ceiling is constructed with acoustical tile or is of the drop ceiling type which includes a plurality of rails supporting panels loosely therein by gravity. Such ceiling structures have been quite widely used in various buildings and are subject to being damaged or displaced if excessive vertical pressure is exerted thereon.

Figure 3:
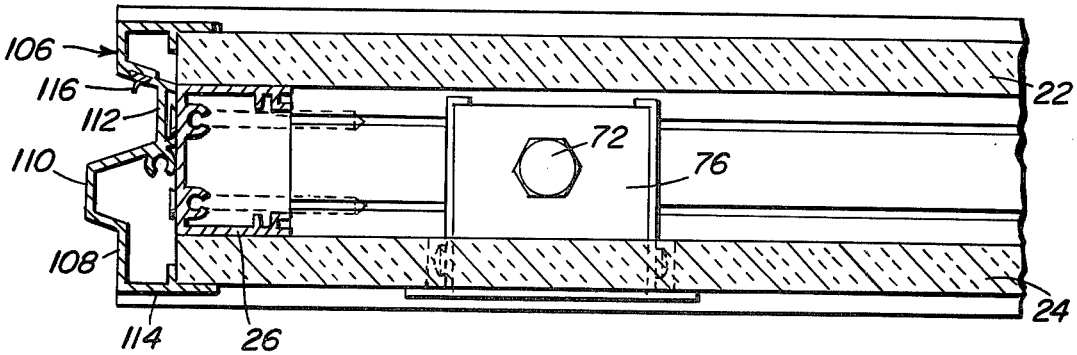
FIG. 3 is a transverse, plan sectional view, on an enlarged scale, taken substantially upon a plane passing along section line 3—3 of FIG. 1.
Figure 4:
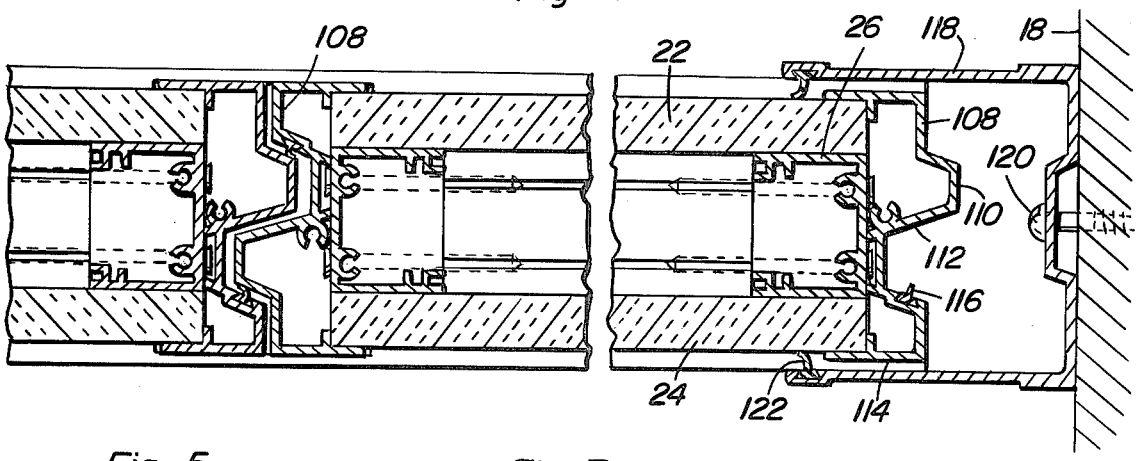
FIG. 4 is a sectional view, similar to FIG. 3 but taken along section line 4—4 of FIG. 1.

The side edges of the panels 12 include a channel shaped member 106 having a bight portion 108 provided with a longitudinal projection 110 and a longitudinal recess 112 and parallel legs 114 telescoped over the panel members 22 and 24 as illustrated in FIG. 3 with the web or bight portion 108 being secured to the frame 26. When adjacent panels 12 are aligned, the projections 110 and recesses 112 are associated with each other in the manner illustrated in FIG. 4 to provide an inter-engagement and one wall of the recess 112 is provided with a vinyl seal strip 116 to provide a vertical seal between the panels 12. The panel 12 which engages a wall 18 has its vertical side edge received in a channel shaped receptor 118 secured to the wall 18 by any suitable screw threaded means, wood screws or other fastening means 120. The legs of the channel shaped receptor 118 telescopically receive the vertical side edge of the panel 12 and each leg is provided with a seal strip 122 as illustrated in FIG. 4.

Figure 8:
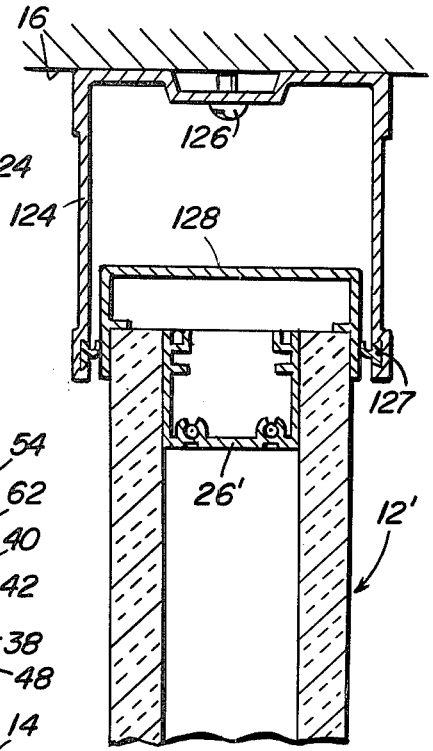
FIG. 8 is a sectional view, similar to the upper portion of FIG. 2 but illustrating a modified form of structure mounted on the ceiling for telescopic engagement with the upper edge of the wall panel.

FIG. 8 illustrates a slightly modified embodiment of the invention in which the ceiling 16 is provided with an inverted U-shaped guide 124 secured to the ceiling with any suitable fastening devices 126. The inner surfaces of the lower edges of the legs of the U-shaped guide 124 are provided with seal strips 127 which sealingly engage an inverted channel shaped member 128 attached to the upper edge of the panel 12'. In this embodiment of the invention as illustrated in FIG. 8, the spring bias arrangement at the upper edge of the panel 12' may be eliminated. The other components at the lower edge of the panel 12' will remain the same. Also, the internal construction between the panel members 22 and 24 has not been illustrated in detail since this will vary depending upon the installational requirements.

The structural features of the portable wall system result in advantages over existing wall systems. By providing vertical adjustment of the floor engaging assembly 30, the side edges of the panels may be disposed in true vertical orientation even though the floor surface may not be level which is the usual situation encountered in many installations. The adjustable floor engaging assembly combined with the rollers eliminates the use of a separate cart or other conveying device employed to transport panels such as shown in the prior art. This also eliminates the necessity of physically lifting and carrying such panels since the variation in the heighth enabled by the adjustable floor engaging assembly and the adjustable ceiling engaging assembly enables the panel heighth to be reduced to a heighth shorter than the distance from the floor to the ceiling thus enabling the panel to be rolled along a supporting surface while in substantially a vertical position.

Also, the use of the U-shaped configuration of the floor engaging member eliminates the necessity of using separate, slotted skirts for concealing the internal components of the prior art panels. Moreover, the channel shaped construction provides a stable engagement with the floor surface and effectively supports the entire weight of the panel.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. In a portable wall system extending generally vertically between a floor and ceiling and including at least one wall panel, that improvement in which the wall panel includes a fixed dimension panel assembly having a vertical heighth only slightly less than the distance between the floor to the ceiling, a floor engaging supporting assembly on the lower edge of said panel assembly for movably supporting the lower end of the panel assembly for moving the wall panel along the surface of the floor, and a manually operated, vertically extendible and retractable lifting assembly continuously along the bottom edge of said panel assembly for selective vertical orientation above the point of contact between the supporting assembly and the floor surface and below the bottom edge of the supporting assembly, the vertical extension of the assembly serving to lift the panel assembly to bring it into engagement with the ceiling and secure the wall panel between the floor and ceiling, and a spring biased assembly at the upper edge of the panel assembly for engagement with the ceiling, said spring biased assembly including spring means exerting a small upward force to compensate for irregularities in building surfaces and to engage the ceiling with a "light touch".

2. The structure as defined in claim 1 wherein said supporting assembly includes a plurality of rolling support members mounted on the bottom edge of said panel assembly for rolling supporting contact with the floor.

3. The structure as defined in claim 1 wherein said extendible and retractable assembly includes a generally U-shaped member having spaced parallel, upwardly extending legs rigid with an inter-connecting bight portion, longitudinally extending, transversely spaced seal members mounted on said bight portion for engagement with the floor surface when in extended position.

4. The structure as defined in claim 3 wherein said supporting assembly is disposed interiorly of the U-shaped member when in extended position, said bight portion having apertures therein enabling passage of the supporting assembly therethrough when the U-shaped member is moved to retracted position thereby enabling the supporting assembly to engage the floor.

5. The structure as defined in claim 4 wherein the bight portion of the U-shaped member includes a plurality of screw threaded members swivelly connected thereto, said panel assembly including threaded blocks receiving the screw threaded members whereby rotation of the screw threaded members will extend and retract said U-shaped member, said screw threaded members being disposed adjacent the vertical side edges of the panel to enable independent adjustment for orienting the side edges of the panel in vertical position.

6. The structure as defined in claim 5 wherein said panel assembly includes a pair of spaced panel members, the lower portion of one of said panel members having a plurality of laterally opening recesses therein, each of said screw threaded members having an upper end terminating in one of said recesses with the upper end of the screw threaded member having a polygonal head thereon to provide access thereto by inserting a tool into the recess.

7. The structure as defined in claim 1, wherein said spring biased assembly includes an inverted channel shaped member having spaced parallel legs telescoped in relation to the upper end of the panel assembly, transversely spaced seal means along the upper surface of the channel shaped member for engaging the ceiling, said spring means including coil springs having widely spaced convolutions thereon to exert a light force on the channel shaped member, and means on the upper surface of the channel shaped member for engaging a positioning means on the ceiling between the seal means on the channel shaped member.

8. The structure as defined in claim 6 wherein the ceiling includes a downwardly opening channel shaped member telescopically receiving the upper end of said wall panel, said extendible and retractable assembly having sufficient vertical movement to enable the upper end of the wall panel to be inserted into the inverted channel shaped member mounted on the ceiling while the supporting assembly is supporting the wall panel in vertical movable position on the floor surface and extension of the extendible and retractable assembly then moving the wall panel upwardly to locate and retain the wall panel in vertical position.

9. The structure as defined in claim 7 wherein said spring biased assembly for engagement with the ceiling includes vertical adjustment means for retracting the spring biased assembly to shorten the heighth of the panel assembly to a vertical dimension less than the floor to ceiling heighth thereby enabling the panel assembly to be moved along the floor surface substantially in a vertical position without manhandling the panel assembly by lifting and supporting the entire weight thereof.

10. In a portable wall system extending generally vertically between a floor and ceiling and including at least one wall panel, that improvement in which the wall panel includes a fixed dimension panel assembly having a vertical heighth only slightly less than the distance between the floor to the ceiling, a floor engaging supporting assembly on the lower edge of said panel assembly for movably supporting the lower end of the panel assembly for moving the wall panel along the surface of the floor, and a manually operated, vertically extendible and retractable assembly along the bottom edge of said panel assembly for selective vertical orientation above the point of contact between the supporting assembly and the floor surface and below the bottom edge of the supporting assembly, the vertical extension of the assembly serving to lift the panel assembly to bring it into engagement with the ceiling and secure the wall panel between the floor and ceiling, and a spring biased assembly at the upper edge of the panel assembly for engagement with the ceiling, said spring biased assembly including spring means exerting a small upward force to compensate for irregularities in building surfaces and to engage the ceiling with a "light touch", said spring biased assembly including an inverted channel shaped member having spaced parallel legs telescoped in relation to the upper end of the panel assembly, transversely spaced seal means along the upper surface of the channel shaped member for engaging the ceiling, said spring means including coil springs having widely spaced convolutions thereon to exert a light force on the channel shaped member, and means on the upper surface of the channel shaped member for engaging a positioning means on the ceiling between the seal means on the channel shaped member, said spring biased assembly for engagement with the ceiling including vertical adjustment means for retracting the spring biased assembly to shorten the heighth of the panel assembly to a vertical dimension less than the floor to ceiling heighth thereby enabling the panel assembly to be moved along the floor surface substantially in a vertical position without manhandling the panel assembly by lifting and supporting the entire weight thereof, said vertical adjustment means including a screw threaded member having a head disposed above the inverted channel-shaped member in rotatable relation thereto for receiving a tool to rotate the screw threaded member for varying the initial position of the inverted channel-shaped member without varying to any appreciable degree the resistance to movement of the channel-shaped member provided by said coil springs, said seal means being disposed along opposite sides of the head of the screw threaded member to conceal the same and providing continuous engagement with the ceiling, said panel including a screw threaded member adjacent each end thereof with the head on the screw threaded member constituting the means for engaging a positioning means on the ceiling between the seal means whereby the seal means also conceals the positioning means, said supporting assembly at the lower edge of the panel assembly including a plurality of ball-type rollers mounted on the lower edge thereof for rolling engagement with a supporting floor surface for movement of the panel assembly in any direction, said extendible and retractable assembly including a channel-shaped member having a bottom, horizontally disposed and substantially continuous bight portion disposed below the rollers when in extended position, said bight portion including apertures to enable the bight portion to move upwardly so that the bight portion may be oriented above the bottom edge of the rollers when in retracted position, screw threaded members threadedly mounted on the panel assembly and journaled to the bight portion of the channel-shaped member whereby rotation of the screw threaded members will cause vertical extension and retraction of the channel-shaped member.

* * * * *